US008677544B1

(12) United States Patent
Raven et al.

(10) Patent No.: US 8,677,544 B1
(45) Date of Patent: Mar. 25, 2014

(54) HAND-WORN DEBRIS REMOVAL DEVICE

(75) Inventors: Meghan M. Raven, Grand Rapids, MI (US); Bryce K. Porter, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/411,007

(22) Filed: Mar. 2, 2012

Related U.S. Application Data

(60) Provisional application No. 61/448,917, filed on Mar. 3, 2011.

(51) Int. Cl.
*A47L 13/18* (2006.01)

(52) U.S. Cl.
USPC ..... 15/106; 15/104.001; 15/227

(58) Field of Classification Search
USPC ..... 15/104.002, 106, 114, 118, 227, 15/104.001; 2/158, 159, 161.3, 161.8
See application file for complete search history.

(56) References Cited

U.S. PATENT DOCUMENTS

| | | | | | |
|---|---|---|---|---|---|
| 1,979,130 | A * | 10/1934 | Wiley | 2/168 |
| D268,967 | S * | 5/1983 | Sami | D32/40 |
| 4,884,374 | A * | 12/1989 | Natale et al. | 451/523 |
| 5,441,355 | A * | 8/1995 | Moore | 401/7 |
| 5,974,613 | A * | 11/1999 | Herzog | 15/22.1 |
| 6,024,970 | A * | 2/2000 | Woodard | 424/402 |
| 7,520,016 | B2 * | 4/2009 | Kressner | 15/22.1 |
| 7,581,273 | B2 * | 9/2009 | Dobrin et al. | 15/104.94 |
| 7,647,667 | B2 * | 1/2010 | Benjamin et al. | 15/104.94 |
| 7,703,163 | B2 * | 4/2010 | Jimenez et al. | 15/22.1 |
| 7,788,756 | B2 * | 9/2010 | Kraemer | 15/28 |
| 7,823,244 | B2 * | 11/2010 | Knopow et al. | 15/227 |
| 7,908,673 | B2 * | 3/2011 | Kerr-Maddox et al. | 2/163 |
| 7,972,464 | B2 * | 7/2011 | Saiki | 156/296 |
| 8,038,310 | B1 * | 10/2011 | Hale et al. | 362/103 |
| 8,069,526 | B2 * | 12/2011 | Malaska | 15/227 |
| 8,133,568 | B2 * | 3/2012 | Rockwell | 428/116 |
| 2002/0166188 | A1 * | 11/2002 | Driesen et al. | 15/192 |
| 2003/0049407 | A1 * | 3/2003 | Kacher et al. | 428/100 |
| 2003/0154568 | A1 * | 8/2003 | Boland et al. | 15/28 |
| 2005/0091767 | A1 * | 5/2005 | Jimenez et al. | 15/22.1 |
| 2006/0248667 | A1 * | 11/2006 | Kraemer | 15/28 |
| 2007/0061986 | A1 * | 3/2007 | Huntington | 15/227 |
| 2007/0067933 | A1 * | 3/2007 | Waguespack | 15/167.1 |
| 2007/0118963 | A1 * | 5/2007 | Snyder | 2/158 |
| 2009/0038098 | A1 * | 2/2009 | Chareyron | 15/227 |
| 2011/0041276 | A1 * | 2/2011 | Edwards et al. | 15/227 |
| 2011/0131702 | A1 * | 6/2011 | Rodgers et al. | 2/158 |

* cited by examiner

*Primary Examiner* — Monica Carter
*Assistant Examiner* — Michael Jennings
(74) *Attorney, Agent, or Firm* — McGarry Bair PC

(57) ABSTRACT

A hand-worn debris removal device for cleaning fabric, upholstery, carpet, and other textiles comprises a pocket having a longitudinal axis, a first debris collecting element having unidirectional fibers having a first directional orientation, a second debris collecting element having unidirectional fibers having a second directional orientation opposite the first directional orientation and a gap formed between the first and second debris collecting elements along the longitudinal axis. Movement of the device in a first direction and a second direction across a surface to be cleaned collects debris removed by the first and second debris collecting elements in the gap.

17 Claims, 4 Drawing Sheets

HAND-WORN DEBRIS REMOVAL DEVICE

CROSS-REFERENCE TO RELATED APPLICATION

This application claims the benefit of U.S. Provisional Patent Application No. 61/448,917, filed Mar. 3, 2011, which is incorporated herein by reference in its entirety.

BACKGROUND OF THE INVENTION

Lint and hair removal devices for cleaning fabric, upholstery, carpet, and other textiles can comprise directional fabric, or elastomeric materials fastened to a wearable glove or mitten. Generally, the devices collect hair and debris in a single stroke direction.

BRIEF DESCRIPTION OF THE INVENTION

According to another embodiment, the surface being cleaned has a nap, and wherein movement of the debris removal device across the surface being cleaned in alternating first and second directions raises the nap of a material of the surface being cleaned in at least one of the first and second directions, and collects debris removed from the surface being cleaned in the gap.

According to yet another embodiment, the first directional orientation and the second directional orientation are both oriented toward the gap.

In another embodiment, the device further comprising a wristband located around a periphery of the opening into the internal cavity of the debris removal device. The wristband comprises a hook and loop fastener for retaining the debris removal device on a user's hand.

According to another embodiment, the first and second debris collecting elements are formed from a material selected from the group consisting of: polyester having unidirectional polyester-oriented fibers, velour, synthetic fibers, glass fibers, wool and combinations thereof. The first and second debris collecting element can have a denier of about 450. The unidirectional fibers of the first and second debris collecting elements can have a fluff height of about 1.3 mm to 1.7 mm. The first and second debris collecting elements can have a fabric weight of about 450-500 g/m$^2$.

According to yet another embodiment, the device further comprises a third debris collecting element located proximal the opening into the internal cavity and a fourth debris collecting element located distal the opening into the internal cavity on the other of the first and second sides of the debris removal debris opposite the first and second debris collecting elements. The third debris collecting element can generally span a width of the one of the at least one first and second sides of the debris removal device. The third debris collecting element can be formed from the same material as at least one of the first and second debris collecting elements. The fourth debris collecting element can have a plurality of protrusions thereon. The fourth debris collecting element can be formed from a material selected from the group consisting of: elastomeric materials, silicone rubber, EPDM, natural rubber, nitrile rubber and combinations thereof.

According to another embodiment, the internal cavity has a predetermined size selected to receive a user's hand falling between the 5$^{th}$ and 95$^{th}$ percentile of human hand sizes.

In another embodiment, the first and second sides of the debris removal device are formed from a material selected from the group consisting of: spun-bonded nonwoven polypropylene, nylon, cotton, non-woven materials comprising nylon or polyester fibers, and a polyurethane-polyurea copolymer.

According to an embodiment of the invention, a hand-worn debris removal device comprises a pocket formed by a first side and an opposing second side defining an internal cavity having an opening for receipt of a user's hand in the internal cavity, wherein the pocket comprises a longitudinal axis extending through the opening. The device further comprises a first debris collecting element provided on at least one of the first and second sides and having unidirectional fibers having a first directional orientation, a second debris collecting element provided on the same side as the first debris collecting element and having unidirectional fibers having a second directional orientation, and a gap formed between the first and second debris collecting elements along the longitudinal axis. The first directional orientation of the unidirectional fibers of the first debris collecting element and the second directional orientation of the unidirectional fibers of the second debris collecting element are oriented toward the gap formed between the first and second debris collecting elements. The device further includes a third debris collecting element located proximal the opening into the internal cavity and a fourth debris collecting element located distal the opening into the internal cavity on the other of the first and second sides of the debris removal device opposite the first and second debris collecting elements. Movement of the device in a first direction across a surface to be cleaned corresponds to one of the first and second directional orientation of one of the first and second debris collecting elements and movement of the device in a second direction across a surface to be cleaned corresponds to the other of the first and second directional orientation of one of the first and second debris collecting elements such that debris removed by the first and second debris collecting elements collects in the gap.

According to an embodiment of the invention, a hand-worn debris removal device comprises a pocket formed by a first side and an opposing second side defining an internal cavity having an opening for receipt of a user's hand in the internal cavity, wherein the pocket comprises a longitudinal axis extending through the opening. The device further comprises a first debris collecting element provided on at least one of the first and second sides and having unidirectional fibers having a first directional orientation, a second debris collecting element provided on the same side as the first debris collecting element and having unidirectional fibers having a second directional orientation, and a gap formed between the first and second debris collecting elements along the longitudinal axis. The first directional orientation of the unidirectional fibers of the first debris collecting element and the second directional orientation of the unidirectional fibers of the second debris collecting element are oriented toward the gap formed between the first and second debris collecting elements. The device further includes at least one of a third debris collecting element located proximal the opening into the internal cavity or a fourth debris collecting element located distal the opening into the internal cavity on the other of the first and second sides of the debris removal device opposite the first and second debris collecting elements. Movement of the device in a first direction across a surface to be cleaned corresponds to one of the first and second directional orientation of one of the first and second debris collecting elements and movement of the device in a second direction across a surface to be cleaned corresponds to the other of the first and second directional orientation of one of the first and second debris collecting elements such that debris removed by the first and second debris collecting elements collects in the gap.

DESCRIPTION OF EMBODIMENTS OF THE INVENTION

Figure 1:
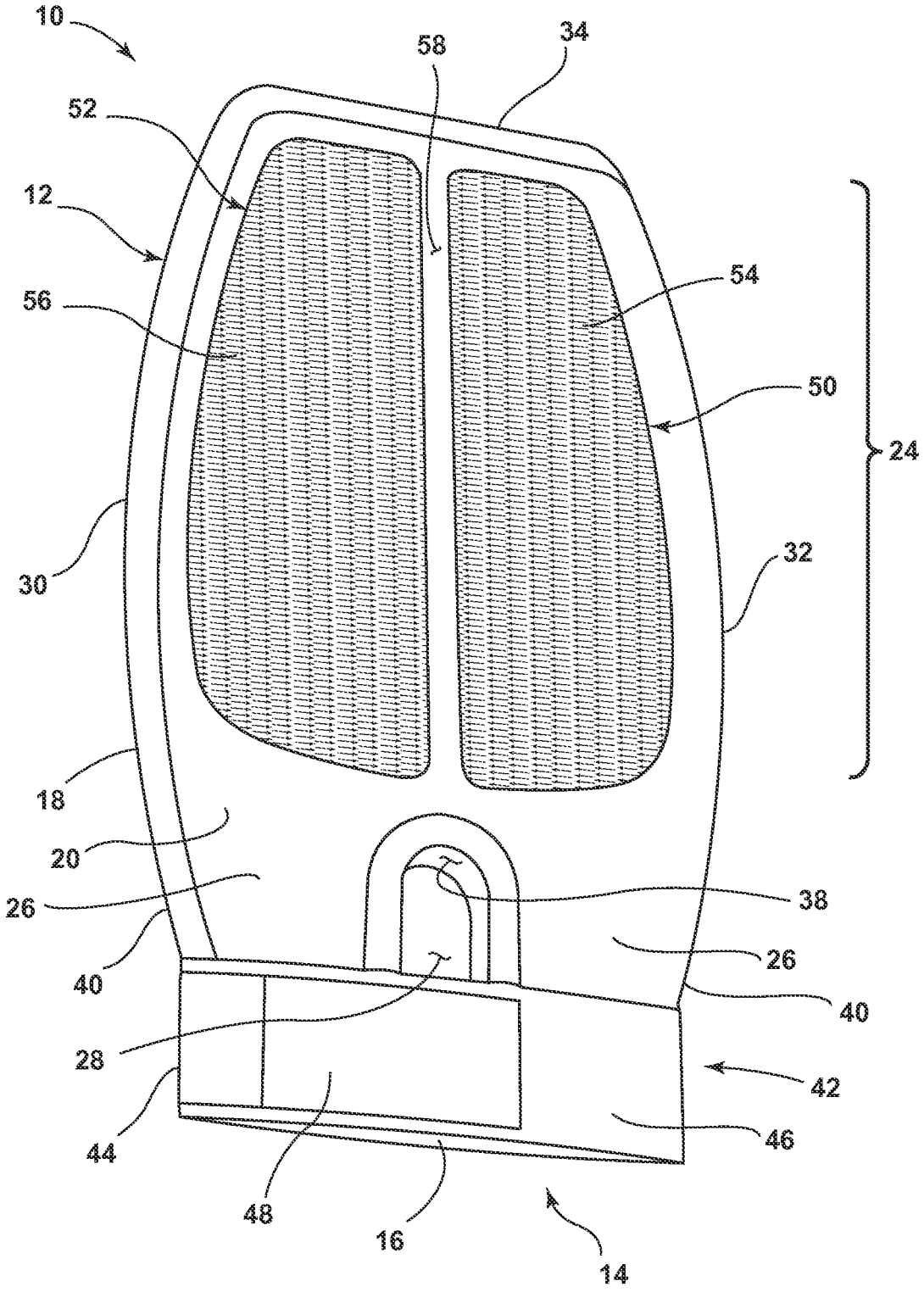
FIG. 1 is a front perspective view of a lint and hair removal device according to the invention.
Figure 2:
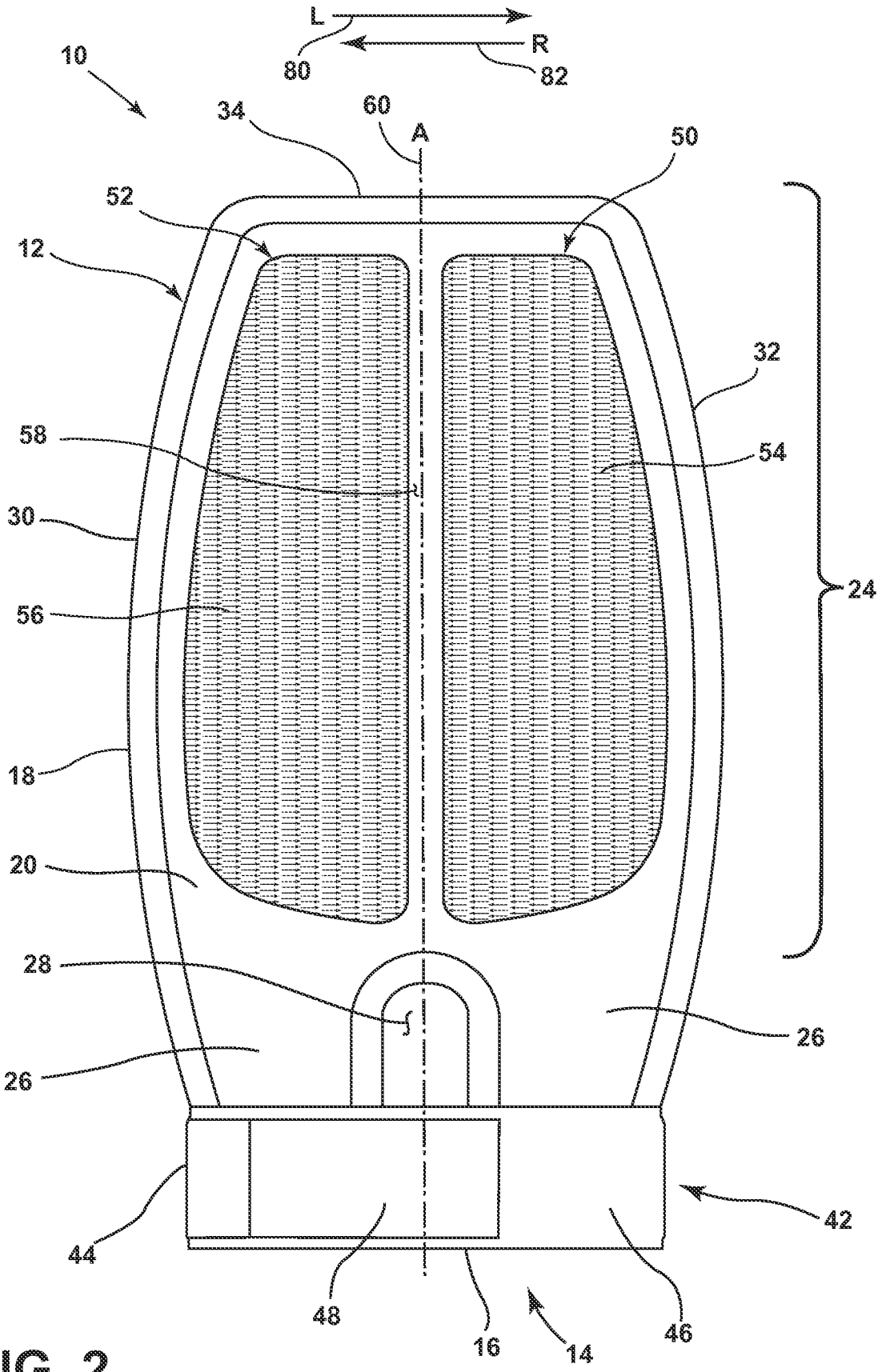
FIG. 2 is a view of opposed directional material on the lint and hair removal device of FIG. 1 as viewed from the surface to be cleaned.
Figure 3:
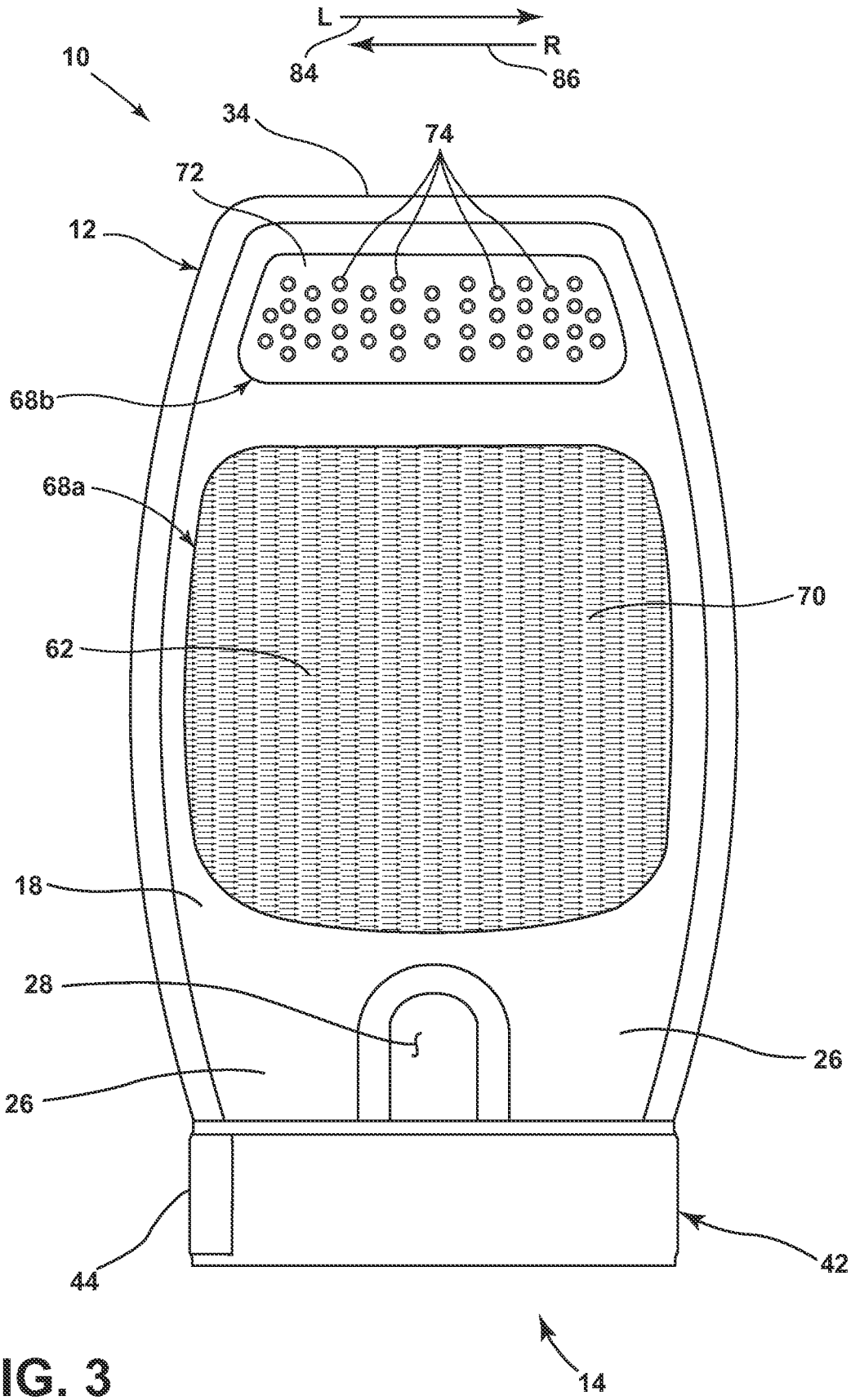
FIG. 3 is a view of a combination of directional material and an elastomeric strip on the lint and hair removal device of FIG. 1 as viewed from the surface to be cleaned.

Referring to the drawings, and in particular to FIGS. 1-3, a hand-worn device 10 for removing debris, such as lint and hair, for example, comprises a partially enclosed oblong flexible fabric mitten-like pocket or mitt 12 that further comprises an adjustable wrist opening 14 formed in a proximal open end 16 thereof. A top sheet or side 18 and a bottom sheet or side 20 comprising flexible fabric define the top and bottom surfaces of the pocket 12. The bottom sheet 20 comprises a generally rectangular body portion 24 with fabric tails 26 that extend outwardly from the proximal open end 16. A U-shaped slit 28 is formed between the fabric tails 26. First and second outwardly curved elongate side edges 30, 32 extend from the outer edges of the fabric tails 26, along the rectangular body portion 24 and merge into a shorter, arcuate end edge 34 that is orthogonal to the side edges 30, 32. The top sheet 18 dimensions are identical to and correspond with the dimensions the bottom sheet 20.

The top sheet 18 and bottom sheet 20 are fastened together along the elongate side edges 30, 32 and the shorter arcuate end edge 34. The top sheet 18 and bottom sheet 20 can be fastened together by any suitable manufacturing method such as sewing, fabric adhesive, or other bonding processes such as heat fusing, for example. A cavity 38 is formed between the top sheet 18 and bottom sheet 20, and is sized to accommodate a wide range of user hand sizes. Moreover, the adjustable wrist opening 14 is configured so that the tails 26 separated by the U-shaped slit 28 can be spread apart outwardly or squeezed inwardly to accommodate a wide range of user wrist sizes. It will be understood that the exact manner in which the top and bottom sheets 18, 20 are formed to provide the cavity 38 is not germane to the invention. For example, the top and bottom sheets 18, 20 can be formed from a single piece of material that is folded and fastened along one side edge and optionally also along the end edge.

The adjustable wrist opening 14 is formed at the proximal open end 16 of the pocket 12 by fabric tails 26 extending outwardly from the top and bottom sheets 18, 20 that are fastened together along their corresponding outer edges 40 with U-shaped slits 28 formed therebetween. Accordingly the fastened fabric tails 26 form an expandable cuff 42 that can be expanded or constricted depending on the user's hand and wrist size. An adjustable strap 44 is secured to a portion of the cuff 42 and extends partially around the circumference of the cuff 42 for securing the cuff 42 to a user's wrist. The adjustable strap 44 further comprises a strip of conventional hook and loop closure material such as Velcro® that is approximately ½ inch wide. A fixed end 46 of the strap 44 is fastened to a portion of the cuff 42 and a free end 48 of the strap 44 can be selectively released, adjusted, and secured to permit a user to selectively adjust and secure the cuff 42 of the mitt 10 to their wrist, or conversely, to remove the mitt 10. Alternatively, instead of hook and loop material, the strap 44 can comprise an elastic material, or a fabric material with a conventional buckle clasp, for example.

The flexible fabric used to form the top and bottom sheets 18, 20 can comprise conventional spun bonded non-woven polypropylene material with a fabric weight of 200 grams per square meter, although a wide range of fabric weights is contemplated depending upon the desired flexibility of the mitt. Lower fabric weights are thinner and more flexible while higher fabric weights are thicker and less flexible. Alternatively, a variety of substitute flexible fabrics can be used such as conventional woven or non-woven materials or blends thereof. For example, nylon, cotton, or non-woven materials comprising nylon or polyester fibers, can be used. Alternatively, the fabric can comprise a stretchable material, such as material made from a polyurethane-polyurea copolymer, an example of which includes Spandex®. Still further, the top sheet 18 and bottom sheet 20 can comprise dissimilar materials of different fabric types, fabric weights, or both to vary the feel and flexibility of the mitt 10.

As previously described, the pocket 12 comprises an internal cavity 38 that is sized to provide sufficient space to accommodate a $5^{th}$ to $95^{th}$ percentile user's fingers, thumb, palm and wrist size. Alternatively, the mitt 10 can comprise one or more separate pockets that are partially divided and sized to receive a user's finger(s) and/or thumb such as a more traditional glove, for example.

As can best be seen in FIG. 2, the bottom sheet 20 can further comprise first 50 and second 52 debris or lint and hair collecting elements fastened to the outer surface thereof. The first and second debris, or lint and hair, collecting elements 50, 52 comprise generally rectangular-shaped pieces of conventional directional fabric that are fastened to the bottom sheet 20, oriented side by side and spaced apart by a gap 58 therebetween formed along a central longitudinal axis "A" 60. The lint and hair collecting elements 50, 52 can be sewn to the bottom sheet 20 or otherwise fastened via suitable means such as fabric adhesive or fuse bonding, for example. Each lint and hair collecting element 50, 52 comprises directional fabric having unidirectional oriented fibers 54 and 56, respectively. The unidirectional oriented fibers 54 and 56 have been illustrated as small arrows indicating the direction of orientation of the fibers for the purposes of discussion. It will be understood that the term unidirectional oriented fibers refers to a group of fibers in which a majority of the fibers have the same general alignment and the same general orientation and further that there may be some variation in the alignment and orientation of the fibers naturally and/or due to manufacturing processes.

The directional fabric of the first and second lint and hair collecting elements 50, 52 can comprise a 450 denier base polyester material with unidirectional polyester oriented fibers having a fluff height of 1.3-1.7 mm. A denier is a term used in the textile industry and refers to the unit of linear mass density of fibers, defined as the mass in grams per 9,000 meters. The fabric weight is preferably 450-500 grams per square meter, although additional weights are also suitable depending upon the desired flexibility. An example of a suitable directional fabric is commercially available from Ju Rong Shi Xin Cai Gong Yi Zhi Zao Chang as "Type C" lint fabric. Alternatively, the directional fabric can comprise other fabric types such as velour or other fabrics that include cut or uncut loops of fibers, such as natural fibers, synthetic fibers, glass fibers, thread, or wool provided that a majority of the fibers are oriented or tilted in one direction. The first lint and hair collecting element 50 is oriented inwardly so that the unidirectional fibers 54 are effective at guiding debris towards the gap 58 when the mitt 10 is moved in a first direction. Likewise, the second lint and hair collecting element 52 is also oriented inwardly so that the unidirectional fibers 56 are effective at guiding debris towards the gap 58 when moved in a second direction, opposite the first direction. Accordingly, the unidirectional fibers 54, 56 of the first and second lint and hair collecting elements 50, 52 oppose each other and are both oriented inwardly towards the gap 58 along longitudinal axis "A" 60.

Referring now to FIG. 3, the top sheet 18 can comprise third and fourth lint and hair collecting elements 68*a* and 68*b*, respectively, one or both of which can be dissimilar and/or similar to those on the bottom sheet 20. As shown in FIG. 3, the third lint and hair collecting element 68*a* comprises a piece of directional fabric, having a generally square shape, further comprising unidirectional fibers 62 oriented along a lateral axis. The third lint and hair collecting element 68*a* can be similar to one of the first and second lint and hair collecting elements 54, 56 and can be assembled in the same manner as described above for the first and second lint and hair collecting elements 54, 56.

The fourth lint and hair collecting element 68*b* can comprise an elastomeric strip 72 that can be fastened to the top sheet 18 above the third lint and hair collecting element 68*a* near the end edge 34 of the pocket 12. The strip 72 can be fastened to the top sheet 18 via sewing, adhesive, staples, or other suitable methods such as mechanical retention or overmolding, for example. The strip 72 can further comprise a plurality of raised elastomeric projections in the form of nubs 74 protruding outwardly from the strip 72. The nubs 74 can comprise rounded ends and can be arranged in rows or any other pattern. Alternatively, the strip 72 can comprise blades or other projections (not shown) instead of or in addition to the nubs 74, all of which facilitate removal of hair and lint from the surface to be cleaned.

The strip 72 preferably comprises silicone rubber with a Shore A hardness rating. Alternatively, the strip 72 can comprise a thermoplastic elastomeric material, such as EPDM (ethylene propylene diene monomer), or natural or synthetic rubber, such as nitrile rubber, for example.

Referring again to FIGS. 2 and 3, FIG. 2 shows a view of the first and second lint and hair removal elements 50, 52 as viewed from the surface to be cleaned, and FIG. 3 shows a view of the third and fourth lint and hair removal elements 68*a, b* as viewed from the surface to be cleaned.

Figure 4:
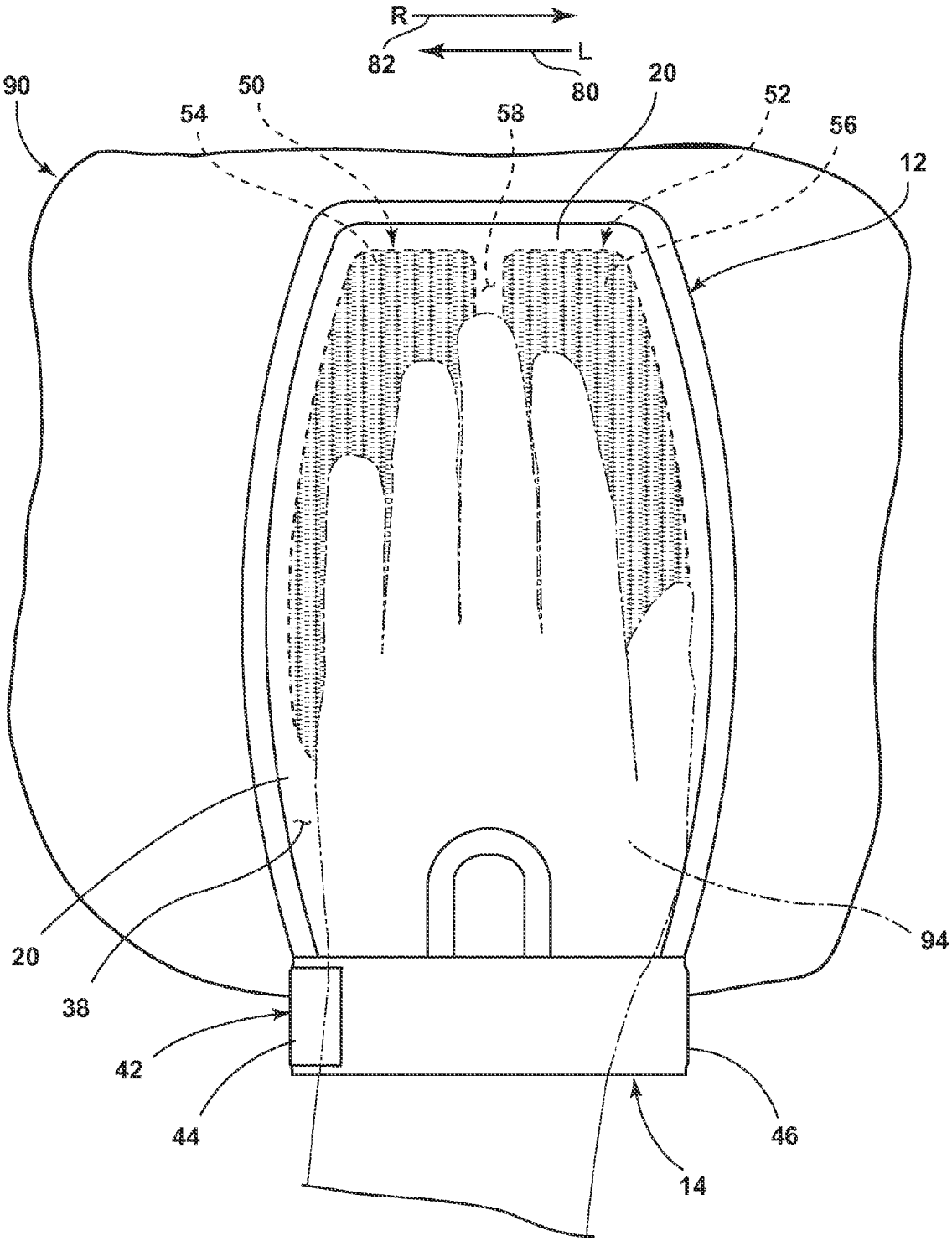
FIG. 4 illustrates the use of the lint and hair removal device of FIG. 1 on a surface to be cleaned.

FIG. 4 illustrates the use of the mitt 10 on a surface 90 to be cleaned such as upholstery, drapery, floor coverings, clothing, the coat of a pet, etc. . . . . FIG. 4 illustrates a portion of the surface to be cleaned, which may have a plurality of fibers or hairs (not shown). Portions of the mitt 10, such as the third and fourth lint and hair removal elements 68*a, b* of side 18 have been removed for the purposes of clarity. In operation, a user loosens the strap 44 by pulling on the free end 48 to expand the cuff 42 of the mitt 10. The user slides a hand 94 through the adjustable wrist opening 14 and into the cavity 38 inside the pocket 12. It is envisioned that the user's palm will be adjacent the side 18 or 20 which the user intends to use to clean the surface 90, which in the process illustrated in FIG. 4 is side 20, but it is within the scope of the invention for the user's palm to be adjacent the side 18 or 20 that is not in use. The user then adjusts the free end 48 of the strap 44 and secures it to the fixed end 46 to tighten the expandable cuff 42 around their wrist and secure the mitt 10 to the hand. Next, with the user's palm facing the bottom sheet 20, the user presses the bottom sheet 20 and associated first and second lint and hair collecting elements 50, 52 against the surface to be cleaned. Next, the user wipes the mitt 10 across the surface 90 along a left moving stroke "L" 80, to the left of the user, followed by a right cleaning stroke "R" 82, to the right of the user in the opposite direction. It is envisioned that the user continues to wipe the mitt 10 across the surface 90 using any combination of alternating and/or repeated cleaning strokes, "L" 80 and "R" 82.

A left stroke "L" 80 is with the lay of the unidirectional fibers 54 on the first lint and hair collecting element 50, meaning that a left stroke "L" tends to push the fibers 54 downwardly and inwardly towards the central longitudinal axis "A" 60. Conversely, a left stroke "L" 80 is against the lay of the unidirectional fibers 56 on the second lint and hair collecting element 52. Accordingly, on the left stroke "L" 80, the unidirectional fibers 56 of the second lint and hair collecting element 52 may tend to raise the nap on the surface 90 of any fibers that may be generally oriented in the opposite direction of the fibers 56, and remove and collect lint, hair and other debris therefrom.

A right cleaning stroke "R" 82 is with the lay of the unidirectional fibers 56 on the second lint and hair collecting element 52 and against the lay of the unidirectional fibers 54 on the first lint and hair collecting element 50. Accordingly, when the mitt 10 is wiped along a right cleaning stroke "R" 82, the unidirectional fibers 56 of the second lint and hair collecting element 52 are pushed downwardly and inwardly towards longitudinal axis "A" 60. Moreover, the fibers 56 of the second lint and hair collecting element 52 tend to release any previously collected lint, hair and debris as the mitt 10 is moved in a right cleaning stroke "R" 82. Conversely, the opposing unidirectional fibers 54 of the first lint and hair collecting element 50 tend to raise the nap of any fibers on the surface 90 that may be generally oriented in the opposite direction of the fibers 54, and remove and collect lint, hair and other debris therefrom.

The lint, hair and other debris collected by the fibers 54 of the first lint and hair collecting element 50 is then released from the fibers 54 towards the gap 58 when the cleaning stroke is again switched from the right stroke "R" 82 to the left stroke "L" 80. Accordingly, as the user wipes the mitt 10 along alternating left and right cleaning strokes "L" 80 and "R" 82, lint, hair and other debris accumulates within the gap 58 along longitudinal axis "A" 60. The debris tends to accumulate in a dense, cylindrical pile within and adjacent the gap 58 so that the user can easily collect and dispose the debris pile into a waste receptacle.

While the method of use of the mitt 10 is described with respect to alternating left and right strokes, it will be understood that multiple strokes in a single direction can be completed before alternating to one or more strokes in the opposite direction. In addition, it will be understood that the mitt 10 can be used on a surface having a unidirectional nap or a non-unidirectional nap in a similar manner.

Additionally, the user can wipe the top sheet 18 and third and fourth lint and hair collecting elements 68*a, b* across the surface to be cleaned. A user can press the back of their hand against the cleaning surface and wipe the top of the mitt 10 across the surface along left and right strokes. Alternatively, the user may first loosen the strap 44 and rotate the mitt 10 so that the user's palm faces the top sheet 18 prior to commencing left and right cleaning strokes. The third lint and hair collecting element 68*b* with unidirectional fibers 62 is oriented to collect debris, including lint and hair, as the mitt 10 is moved along a left cleaning stroke "L" 84. The debris can be released from the third lint and hair collecting element 68*b* by wiping the mitt 10 along a right cleaning stroke direction "R" 86. The user can collect the debris and dispose the debris into a waste receptacle. Furthermore, the user can wipe the elastomeric strip 72 with associated nubs 74 (or blades) across the surface to be cleaned. The moving contact between the elastomeric strip 72 and the surface to be cleaned can generate an electrostatic charge on the strip 72 and associated nubs 74 (or blades), which can attract a large quantity of lint, hair and debris. Moreover, the elastomeric strip 72 is fastened near the narrow end edge 34 of the pocket 12 and can be manipulated and deformed to access tight crevices other hard to reach places. The user can then wipe the debris from the elastomeric strip 72 and dispose it in a waste receptacle.

While the invention has been specifically described in connection with certain specific embodiments thereof, it is to be understood that this is by way of illustration and not of limitation, and the scope of the appended claims should be construed as broadly as the prior art will permit.

What is claimed is:

1. A hand-worn debris removal device comprising:

a pocket formed by a first side and an opposing second side defining an internal cavity having an opening for receipt of a user's hand in the internal cavity, wherein the pocket comprises a longitudinal axis extending through the opening;

a first debris collecting element provided on at least one of the first and second sides and having unidirectional fibers having a first directional orientation;

a second debris collecting element provided on the same side as the first debris collecting element and having unidirectional fibers having a second directional orientation;

a gap formed between the first and second debris collecting elements along the longitudinal axis, wherein the first directional orientation of the unidirectional fibers of the first debris collecting element and the second directional orientation of the unidirectional fibers of the second debris collecting element are oriented toward the gap formed between the first and second debris collecting elements;

a third debris collecting element located proximal the opening into the internal cavity; and a fourth debris collecting element located distal the opening into the internal cavity on the other of the first and second sides of the debris removal device opposite the first and second debris collecting elements;

whereby movement of the device in a first direction across a surface to be cleaned corresponds to one of the first and second directional orientation of one of the first and second debris collecting elements and movement of the device in a second direction across a surface to be cleaned corresponds to the other of the first and second directional orientation of one of the first and second debris collecting elements such that debris removed by the first and second debris collecting elements collects in the gap.

2. A hand-worn debris removal device comprising:

a pocket formed by a first side and an opposing second side defining an internal cavity having an opening for receipt of a user's hand in the internal cavity, wherein the pocket comprises a longitudinal axis extending through the opening;

a first debris collecting element provided on at least one of the first and second sides and having unidirectional fibers having a first directional orientation;

a second debris collecting element provided on the same side as the first debris collecting element and having unidirectional fibers having a second directional orientation;

a gap formed between the first and second debris collecting elements along the longitudinal axis, wherein the first directional orientation of the unidirectional fibers of the first debris collecting element and the second directional orientation of the unidirectional fibers of the second debris collecting element are oriented toward the gap formed between the first and second debris collecting elements; and at least one of a third debris collecting element located proximal the opening into the internal cavity or a fourth debris collecting element located distal the opening into the internal cavity on the other of the first and second sides of the debris removal device opposite the first and second debris collecting elements;

whereby movement of the device in a first direction across a surface to be cleaned corresponds to one of the first and second directional orientation of one of the first and second debris collecting elements and movement of the device in a second direction across a surface to be cleaned corresponds to the other of the first and second directional orientation of one of the first and second debris collecting elements such that debris removed by the first and second debris collecting elements collects in the gap.

3. The hand-worn debris removal device of claim 2 wherein the surface being cleaned has a nap, and wherein movement of the debris removal device across the surface being cleaned in alternating first and second directions raises the nap of a material of the surface being cleaned in at least one of the first and second directions, and collects debris removed from the surface being cleaned in the gap.

4. The hand-worn debris removal device of claim 2 wherein the first directional orientation is directly opposite the second directional orientation.

5. The hand-worn debris removal device of claim 2 and further comprising a wristband located around a periphery of the opening into the internal cavity of the debris removal device.

6. The hand-worn debris removal device of claim 5 wherein the wristband comprises a hook and loop fastener for retaining the debris removal device on a user's hand.

7. The hand-worn debris removal device of claim 2 wherein the first and second debris collecting elements are formed from a material selected from the group consisting of: polyester having unidirectional polyester-oriented fibers, velour, synthetic fibers, glass fibers, wool or combinations thereof.

8. The hand-worn debris removal device of claim 2 wherein the first and second debris collecting elements have a denier of about 450.

9. The hand-worn debris removal device of claim 2 wherein the unidirectional fibers of the first and second debris collecting elements have a fluff height of about 1.3 mm to 1.7 mm.

10. The hand-worn debris removal device of claim 2 wherein the first and second debris collecting elements have a fabric weight of about 450-500 g/m$^2$.

11. The hand-worn debris removal device of claim 2, further comprising a third debris collecting element located proximal the opening into the internal cavity and a fourth debris collecting element located distal the opening into the internal cavity on the other of the first and second sides of the debris removal device opposite the first and second debris collecting elements.

12. The hand-worn debris removal device of claim 2 wherein the third debris collecting element generally spans a width of the one of the at least one first and second sides of the debris removal device.

13. The hand-worn debris removal device of claim 2 wherein the third debris collecting element is formed from the same material as at least one of the first and second debris collecting elements.

14. The hand-worn debris removal device of claim 2 wherein the fourth debris collecting element has a plurality of protrusions thereon.

15. The hand-worn debris removal device of claim 14 wherein the fourth debris collecting element is formed from a material selected from the group consisting of: elastomeric materials, silicone rubber, EPDM, natural rubber, nitrile rubber or combinations thereof.

16. The hand-worn debris removal device of claim 2 wherein the internal cavity has a predetermined size selected to receive a user's hand falling between the $5^{th}$ and $95^{th}$ percentile of human hand sizes.

17. The hand-worn debris removal device of claim 2 wherein the first and second sides of the debris removal device are formed from a material selected from the group consisting of: spun-bonded nonwoven polypropylene, nylon, cotton, non-woven materials comprising nylon or polyester fibers, or a polyurethane-polyurea copolymer.

* * * * *